United States Patent [19]

Baldwin

[11] 4,397,414

[45] Aug. 9, 1983

[54] COMPOSITE CONTAINERS

[75] Inventor: Raymond Baldwin, Romiley, England

[73] Assignee: Metal Box Limited, Reading, England

[21] Appl. No.: 268,985

[22] PCT Filed: Sep. 26, 1980

[86] PCT No.: PCT/GB80/00149

§ 371 Date: Jun. 4, 1981

§ 102(e) Date: Jun. 3, 1981

[87] PCT Pub. No.: WO81/00994

PCT Pub. Date: Apr. 16, 1981

[30] Foreign Application Priority Data

Oct. 4, 1979 [GB] United Kingdom ..... 7934566

[51] Int. Cl.[3] ..... B65D 45/32

[52] U.S. Cl. ..... 229/5.7; 220/307; 220/319; 229/5.5

[58] Field of Search ..... 229/5.5, 5.7; 220/307, 220/254, DIG. 19, 352, 319

[56] References Cited

U.S. PATENT DOCUMENTS

| | | | |
|---|---|---|---|
| 1,943,568 | 1/1934 | Ware | 229/5.5 |
| 2,074,231 | 3/1937 | Meacham | 220/307 |
| 2,092,118 | 9/1937 | Hodgson | 220/352 |
| 2,652,947 | 9/1953 | Henchert | 220/307 |
| 3,142,433 | 7/1964 | Balocca | 229/5.6 X |
| 3,244,354 | 4/1966 | Bauer | 229/5.5 |
| 3,347,408 | 10/1967 | Baker, Sr. | 220/307 |

FOREIGN PATENT DOCUMENTS

| | | | |
|---|---|---|---|
| 265104 | 9/1968 | Austria | 220/307 |
| 342153 | 12/1959 | Switzerland | 229/5.7 |
| 438987 | 12/1967 | Switzerland . | |
| 475136 | 8/1969 | Switzerland | 229/5.5 |
| 257998 | 9/1926 | United Kingdom . | |
| 435802 | 9/1935 | United Kingdom . | |
| 522566 | 6/1940 | United Kingdom | 220/358 |
| 650297 | 2/1951 | United Kingdom . | |
| 1053677 | 1/1967 | United Kingdom . | |
| 1274542 | 5/1972 | United Kingdom . | |

*Primary Examiner*—William Price
*Assistant Examiner*—Gary E. Elkins
*Attorney, Agent, or Firm*—Diller, Ramik & Wight

[57] ABSTRACT

A container comprises a body (12) having a base and an open mouth (18). A protective ring (20) fits snugly over a rim (16) of the body (12) encircling the mouth (18), and a closure (38) is insertable into the ring (20) to close the mouth (18). The ring has an outer portion (22) which lies against an outer surface (24) of the body (12) adjacent to the rim (16) and which has an inturned flange (26) biting into said outer surface (24), and an inner portion (28) which has a curled edge region (30) curved to provide the latter with a concealed edge (34) and engageable behind a shoulder (42) on the closure (38). The closure (38) or the ring (20) is resiliently deflectable to permit insertion of the closure (38) through the ring (20).

4 Claims, 2 Drawing Figures

COMPOSITE CONTAINERS

TECHNICAL FIELD

This invention relates to containers of the kind commonly known as composite containers, that is to say a container having a body comprising a shell of paperboard material (as hereinafter defined), and a base member sealably closing the bottom end of the shell. The invention is however concerned with composite containers of the particular kind which each has a removable closure, the body having a protective metal ring secured fast over the top end of the shell to define an open mouth of the container body and the closure being insertable into tight sealing engagement with the ring.

The term "paperboard" is to be understood to mean any material consisting wholly or partly of paperboard, cardboard or the like, whether or not the material of the shell includes also one or more other materials, for example metal foil or plastics, applied as a layer to one or both surfaces of the paperboard or otherwise incorporated in the material.

BACKGROUND ART

Composite containers whose body shells are at least partially formed from paperboard are well known. Such containers commonly comprise a plurality of layers of material spirally or convolutely wound one upon the other to provide a generally cylindrical cardboard body whose interior is lined with metal foil or other protective material. During manufacture, the layers of material are continuously wound to produce a tube from which the body shells are severed.

To close the body of such a container it has been proposed to secure a base over one end and slidably to insert into the other end a removable closure. However, disadvantages of this arrangement are firstly that the severing operation to produce each body tends to give rise to slivers of cardboard which may be dislodged into the contents of the container by repeated removal and insertion of the closure; and secondly the closure tends to damage the foil lining of the body during insertion. Other problems which may occur with this type of container wherein the closure is a sliding fit in the container body are leakage of the contents of the container, and (more importantly in some applications) passage of air into, and gas out of, the body which may impair the storage life of the contents of the container.

One object of this invention is to provide a composite container of the particular kind described above, wherein such disadvantages are avoided and which is of a construction suitable for use as a large sealed container for heavy products, such as paint, as well as for manufacture in smaller sizes for any flowable product that requires to be kept in a sealed condition. Such products may include dry or liquid or semi-liquid foodstuffs.

DISCLOSURE OF INVENTION

The invention accordingly provides a container of the particular kind described above in which the protective metal ring has an inner skirt which comprises a wall portion in the general shape of a frustum of a cone, this wall portion terminating in a curl portion which is of relatively large diameter and substantially toroidal in shape. The curl lies radially inward of the frusto-conical wall portion and has a concealed terminal edge as an important safety feature, this edge facing generally radially-outwardly and downwardly. The removable closure has means which engage behind the curl so that the closure makes a close snap fit in the protective ring. The resilience necessary to establish a snap fit is provided either by the closure or by the inner skirt of the ring, or by both; but both the closure and the inner skirt are sufficiently stiff to have only this resilience, thus providing a close seal between the closure and the container body.

Another important feature of the invention is that in the outer wall portion of the ring, which fits closely around an upper terminal portion of the cylindrical body shell and terminates in a flange, this flange is directed inwardly and upwardly and is spaced radially from the outer wall portion of the ring. In this way the ring is given some resilience whereby the flange which bites into the outer surface of the material of the shell to secure the ring intimately to the latter, is enabled to exert a positive radial force into the shell material.

BRIEF DESCRIPTION OF DRAWINGS

One embodiment of the invention will now be described, by way of example only, with reference to the drawings of this Application, wherein.

BEST MODE OF CARRYING OUT THE INVENTION

Figure 1:
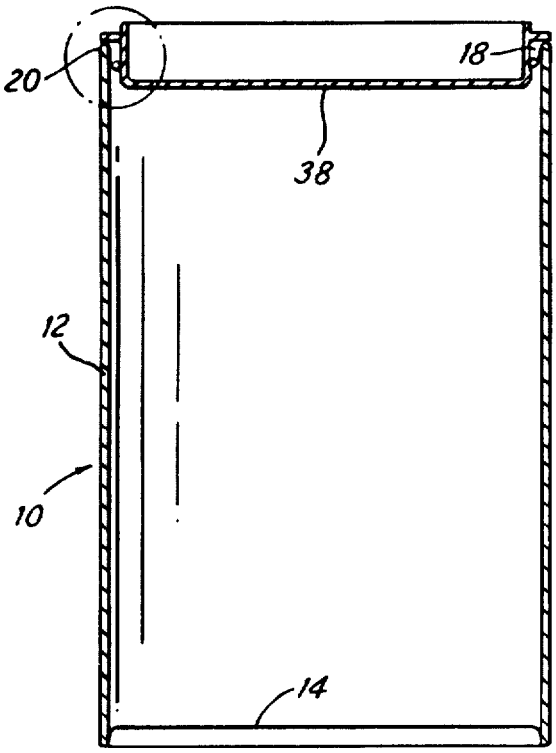
FIG. 1 is an upright, diametral section through a container embodying the invention.
Figure 2:
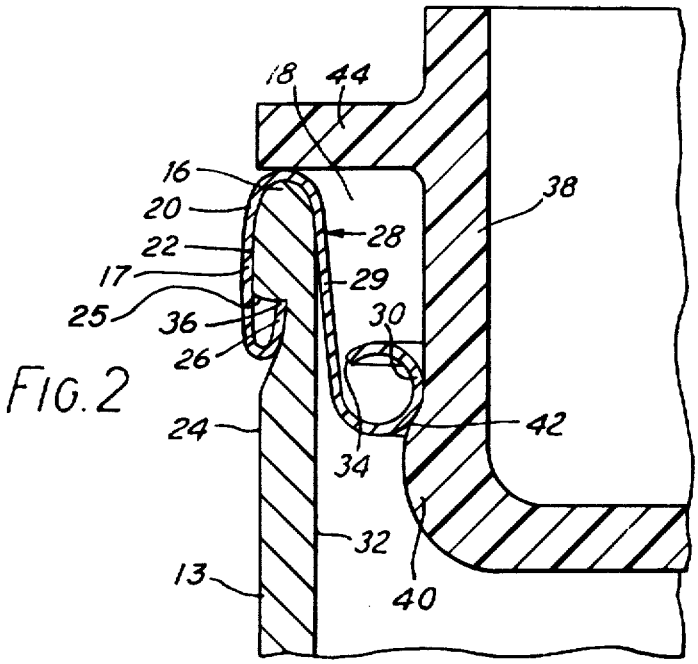
FIG. 2 is an enlarged fragmentary section showing a detail of the container.

FIGS. 1 and 2 illustrate a container 10 whose body comprises a cylindrical shell 12 formed from spirally wound layers of cardboard and foil, the cardboard lying outside the foil. The body 12 includes a base member 14 sealably closing the bottom end of the shell. An end portion 13 of the shell 12 terminates in a rim 16 encircling an open mouth 18 of the container body.

Closely fitted over the rim 16 is a protective ring 20 (see FIG. 2) formed from sheet metal. This ring 20 has an outer wall portion 22 which lies closely against an outer surface 24 of the body end portion 13 and which has an inturned flange 26, directed inwardly and upwardly and spaced from the outer wall portion 22. An inner skirt 28 of the ring 20 comprises an inner wall portion 29 and a generally-toroidal curl portion 30 gradually curving inwardly from an inner surface 32 of the body shell 12, then generally towards the rim 16, and finally downwardly away from the rim 16 and back towards the surface 32 (as shown in FIG. 2) so that a terminal edge 34 of the curl portion 30 faces generally outwardly and downwardly and is thereby concealed. Injury to handlers of the container may thus be avoided. The inner skirt 28 lies against the inner surface 32 adjacent to the rim 16, but is frustoconical in shape, converging downwardly and becoming thus spaced from the inner surface 32 of the body shell toward the curl portion 30, which, by virtue of its curved contour provides a radially-inwardly projecting ridge.

The curl portion 30 is of relatively large diameter, and its terminal edge 34 is preferably spaced slightly, as seen in FIG. 2, from the adjacent inner wall portion 29.

During manufacture of the container body, the inner skirt 28 of the ring 20 is inserted into the container mouth 18, the remainder of the ring, comprising an outer portion 17, being at this time slightly curled from the rim 16 towards the outer surface 24 of the shell 12

(not shown). The terminal edge 36 of the ring is then forced inwardly so as to bite into surface 24 and towards the rim 16, creating a groove 25 in the surface 24. The outer portion 17 is also forced generally towards the surface 24 until the outer portion 17 lies closely against the surface 24 and the in-turned flange 26 is formed. As seen in FIG. 2, the flange 26 thus bites into the surface 24, bearing radially against the groove 25 and thus positively retaining the ring 20 on the end portion 13 of the shell.

In addition to the container body, the container 10 comprises a removable plug closure 38 formed from a resilient plastics material. The closure 38 is hollow and has an enlarged end 40 providing a shoulder 42, behind which the ridge formed by the curl portion 30 of the ring 20 is engageable to hold the closure 38 in the ring. A radially outwardly directed flange 44 is also provided on the closure 38 to abut the rim 16 and thereby prevent the closure from being forced too far into the container body.

As the closure 38 is inserted into the body 12, the enlarged end 40 is resiliently deformed to allow the closure to fit through the ring 20. The closure 38 then snaps into position, closing the mouth 18, the enlarged end 40 returning to its original condition and the edge region 30 of the ring 20 engaging behind the shoulder 42. The shape of the inner skirt 28 is such that it exerts a positive radial force on the closure, there being only sufficient resilience in the closure and in the skirt 28 to permit insertion and removal of the closure. Consequently the inner skirt and closure together constitute a space structure of considerable mechanical strength, by virtue of the opposed radial forces exerted by the skirt and the closure 38 upon each other. The closure is thus positively retained in the mouth 18, a seal being effected between the ring 20 and the closure 38 to inhibit leakage of the container's contents and the passage of gas between the interior of the container and the ambient atmosphere. As illustrated, the contour of the shoulder 42 is arranged to conform to that of the edge region 30, so that an area of contact, rather than a line of contact, is achieved between the two which enhances the sealing effect achieved by the snap fit arrangement of this invention.

In an alternative construction, the closure has a circumferentially extending rib in place of the enlarged end 40 to provide a shoulder behind which the curl portion 30 is engageable.

I claim:

1. A container comprising a container body and a removable closure, the body comprising a cylindrical shell of a paperboard, a base member sealably closing the bottom end of the shell, and a protective metal ring secured fast over a top end of the shell to define an open mouth of the container body, said ring having an outer wall portion fitting closely around an upper terminal portion of the shell and an inner wall portion extending downwards a substantial axial distance from the top end of the shell and terminating in a radially inwardly-directed curl whose terminal edge faces generally downwardly and radially outwardly, said ring further including a bight wall portion joining said inner and outer wall portions, the closure having means to engage behind the curl to secure the closure on the body, the curl being toroidal, of relatively large diameter and rigid, the whole of the inner wall portion being frusto-conical and having just sufficient radial resilience to temporarily deflect radially outwardly to allow the closure to pass the curl portion during insertion into and removal from the container mouth, the outer wall portion terminating in a flange, and the frusto-conical inner wall portion decreasing in diameter in a direction from said bight wall portion toward said curl.

2. A container according to claim 1, wherein the flange which terminates the outer wall portion of the ring is directed inwardly and upwardly, and is spaced radially from said outer wall portion so as to bite resiliently into the paperboard of the body shell.

3. A container comprising a container body and a removable closure, the closure comprising a generally-cylindrical side wall and a flange projecting radially outwardly from an upper portion of said side wall, the body comprising a cylindrical shell of paperboard, a base member sealably closing the bottom end of the shell, and a protective metal ring secured fast over a top end of the shell to define an open mouth of the container body, said ring comprising an outer wall portion fitting closely around, and having a curved section overlying, an upper terminal portion of the shell, said ring further comprising an inner wall portion extending downwards a substantial axial distance from said curved section and terminating in a radially-inwardly directed toroidal curl whose terminal edge faces in a generally radially outward direction, the closure having securing means to engage behind the curl to secure the closure to the body, the curl being significantly more rigid than the inner wall portion, the whole of the inner wall portion being frusto-conical and having just sufficient radial resilience to temporarily deflect radially outwardly to allow said securing means to pass the curl during insertion into and removal from the container mouth, the frusto-conical inner wall portion decreasing in diameter in a direction from said curved section toward said curl, and the closure being out of contact with the ring, except in a first relatively narrow circumferential band whereat the securing means engages the curl and in a second relatively narrow circumferential band whereat the radial flange is in overlying contact with said curved section, whereby the closure is retained in the mouth solely by substantially non-frictional contact with the ring.

4. A container according to claim 3, wherein the angle between said frusto-conical wall portion and the body shell is an acute angle substantially smaller than 45 degrees.

* * * * *